US009932533B2

(12) United States Patent
Rexer, Jr.

(10) Patent No.: US 9,932,533 B2
(45) Date of Patent: Apr. 3, 2018

(54) CRUDE OIL COMPOSITIONS AND METHODS OF PRODUCING HIGH FLASH POINT CRUDE OIL COMPOSITIONS

(71) Applicant: GreenSolve, LLC, Binghamton, NY (US)

(72) Inventor: William F. Rexer, Jr., Binghamton, NY (US)

(73) Assignee: GreenSolve, LLC, Binghamton, NY (US)

( * ) Notice: Subject to any disclaimer, the term of this patent is extended or adjusted under 35 U.S.C. 154(b) by 20 days.

(21) Appl. No.: 14/735,400

(22) Filed: Jun. 10, 2015

(65) Prior Publication Data

US 2015/0360185 A1 Dec. 17, 2015

Related U.S. Application Data

(60) Provisional application No. 62/013,187, filed on Jun. 17, 2014.

(51) Int. Cl.

| | |
|---|---|
| ***C10L 1/04*** | (2006.01) |
| ***C10L 1/02*** | (2006.01) |
| ***C10L 1/14*** | (2006.01) |
| *C10L 1/16* | (2006.01) |
| *C10L 1/185* | (2006.01) |

(52) U.S. Cl.
CPC *C10L 1/04* (2013.01); *C10L 1/02* (2013.01); *C10L 1/14* (2013.01); *C10G 2300/44* (2013.01); *C10L 1/1608* (2013.01); *C10L 1/1857* (2013.01); *C10L 2230/14* (2013.01)

(58) Field of Classification Search
CPC ..... C10L 1/04; C10L 1/02; C10L 1/14; C10L 1/1857; C10L 1/1608; C10L 2230/14; C10G 2300/44
See application file for complete search history.

(56) References Cited

U.S. PATENT DOCUMENTS

| | | | | |
|---|---|---|---|---|
| 3,705,941 | A | 12/1972 | Hennart et al. | |
| 3,867,526 | A | 2/1975 | Hennart et al. | |
| 4,748,289 | A * | 5/1988 | Douglas | C10G 29/00 208/121 |
| 5,064,557 | A | 11/1991 | Fusiak | |
| 5,098,591 | A | 3/1992 | Stevens | |
| 5,393,451 | A | 2/1995 | Koetzle | |
| 5,405,547 | A | 4/1995 | Rinehart | |
| 5,425,893 | A | 6/1995 | Stevens | |
| 5,597,788 | A | 1/1997 | Stevens | |
| 6,187,736 | B1 | 2/2001 | Jarema | |
| 6,260,620 | B1 * | 7/2001 | Furman | C09K 8/52 166/267 |
| 6,843,812 | B2 | 1/2005 | Stephanos | |
| 6,897,008 | B1 | 5/2005 | Hendrickson et al. | |
| 7,166,664 | B1 | 1/2007 | Anderson | |
| 7,176,174 | B2 | 2/2007 | Filippini et al. | |
| 7,273,839 | B2 | 9/2007 | Koetzle | |
| 7,309,684 | B2 | 12/2007 | Filippini et al. | |
| 7,833,959 | B1 | 11/2010 | Koetzle | |
| 7,998,366 | B2 * | 8/2011 | Howard | C11D 7/50 252/182.29 |
| 8,092,715 | B2 | 1/2012 | Howard | |
| 8,414,797 | B2 * | 4/2013 | Howard | C09D 7/001 252/182.29 |
| 2001/0053756 | A1 | 12/2001 | Jarema | |
| 2002/0169090 | A1 | 11/2002 | Foley et al. | |
| 2005/0016431 | A1 * | 1/2005 | Oma | B63B 27/24 114/230.1 |
| 2005/0100823 | A1 | 5/2005 | Hendrickson et al. | |
| 2005/0197267 | A1 | 9/2005 | Zaki et al. | |
| 2006/0019332 | A1 | 1/2006 | Zhang et al. | |
| 2006/0081822 | A1 | 4/2006 | Koetzle | |
| 2006/0128589 | A1 | 6/2006 | Shriner | |

(Continued)

FOREIGN PATENT DOCUMENTS

| | | | |
|---|---|---|---|
| WO | 92/07038 A1 | 4/1992 | |
| WO | 2008/105758 A1 | 9/2008 | |
| WO | WO 2012033742 A1 * | 3/2012 | C08J 11/08 |

OTHER PUBLICATIONS

"Clean Cities of Middle Tennessee"; http://web.archive.org/web/20080405060339/http://www.tennesseecleanfuels.org/Methanol.html; Apr. 5, 2008; 2 pages.

"Cargill Dow and Ashland Sign Ethyl Lactate Agreement: Green Solvents from Renewable Resources"; Business Wire; http//www.allbusiness.com/electronics/electronics-overview/5935032-1.html; Apr. 23, 2002; 3 pages.

International Search Report and Written Opinion for PCT/US10/21350; dated Mar. 3, 2010; 7 pages.

International Search Report and Written Opinion for PCT/US11/43154, dated Feb. 9, 2012, 11 pages.

(Continued)

*Primary Examiner* — Pamela H Weiss

(74) *Attorney, Agent, or Firm* — McNees Wallace & Nurick LLC

(57) ABSTRACT

Transport compositions include a crude oil composition and a solvent formulation including at least one terpene component. In some embodiments, the terpene is a monoterpene. In some embodiments, the terpene is pure gum turpentine, oil of turpentine, a component of turpentine, or a combination of these. Addition of a minimal amount of solvent formulation to the crude oil composition raises the flash point of the mixture, preferably to a predetermined value, which may be in the range of 100 to 120° F., in the range of 120 to 140° F., above 140° F., or above 170° F., depending on the application. The amount of terpene is preferably in the range about 0.005 to about 5 percent by total weight of the transport composition. Methods of raising the flash point of a crude oil composition and methods of increasing the safety of handling a crude oil composition are also disclosed.

22 Claims, No Drawings

(56) References Cited

U.S. PATENT DOCUMENTS

| | | | | |
|---|---|---|---|---|
| 2006/0219405 | A1* | 10/2006 | Nguyen | C09K 8/5083 166/281 |
| 2008/0271761 | A1 | 11/2008 | Sherrel et al. | |
| 2009/0250380 | A1* | 10/2009 | Dana | E21B 43/16 208/390 |
| 2010/0187478 | A1 | 7/2010 | Howard | |
| 2010/0247784 | A1 | 9/2010 | Koetzle | |
| 2011/0152136 | A1* | 6/2011 | Hughes | C09K 8/524 507/232 |
| 2012/0175562 | A1* | 7/2012 | Howard | C09D 7/001 252/364 |
| 2013/0228329 | A1* | 9/2013 | Chesky | E21B 43/16 166/267 |

OTHER PUBLICATIONS

International Search Report and Written Opinion for PCT/US10/60017, dated Aug. 25, 2011, 9 pages.

* cited by examiner

CRUDE OIL COMPOSITIONS AND METHODS OF PRODUCING HIGH FLASH POINT CRUDE OIL COMPOSITIONS

REFERENCE TO RELATED APPLICATIONS

This application claims one or more inventions which were disclosed in Provisional Application No. 62/013,187, filed Jun. 17, 2014, entitled "CRUDE OIL COMPOSITIONS AND METHODS OF PRODUCING HIGH FLASH POINT CRUDE OIL COMPOSITIONS". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of crude oil compositions. More particularly, the invention pertains to compositions and methods for raising the flash point of crude oil compositions.

Description of Related Art

The U.S. federal government has assigned to the Environmental Protection Agency (EPA) the responsibility of regulating man-made volatile emissions, which may pollute the air and atmosphere. The EPA has listed a group of Volatile Organic Compounds (VOCs) as "Exempt VOCs", which is published in the Federal Register under 40 CFR 51.100(s), which is hereby incorporated by reference herein, and addendums. All other VOCs are restricted for use and weight-limited for emission discharge into the atmosphere and environment. Formulators and compounders of products using VOCs are challenged to use and obtain the required VOC combinations for use in their products, to comply with toxic emissions, and to provide for safety in manufacturing, shipping, storage, and ultimate use. VOCs are further subclassified based upon their vapor pressures, boiling points, and flash points. The flash point of the VOC becomes a critical factor for emission discharge and safety, because it is the point at which the liquid becomes a volatile vapor, mixes with oxygen, and thereby acquires its most combustible or flammable state. Flash point, as used herein, refers to the lowest temperature at which a volatile liquid can vaporize to form an ignitable mixture in air. In the United States, the Environmental Protection Agency (EPA) and the Department of Transportation (DOT) have classified such compounds based on their volatilities or "flash points".

The current EPA and DOT Volatile Organic Compound ("VOC") classifications are as follows:

Class I liquids (flammable) flash point at or below 100° F.

Class II liquids (combustible) flash point from 100° F. to below 140° F.

Class III liquids (combustible) flash point above 140° F. to below 200° F.

International standards are generally stricter, with 43° C. (109.4° F.) generally being the separation point between flammable and combustible liquids.

There are currently six commonly used exempt VOCs on the U.S. federal list of acceptable VOCs. Of the six, four have flash points below 10° C./50° F. and they are therefore classified as "flammable and hazardous", thus rendering their respective use to safe and unpopulated areas. P-Chlorobenzotrifluoride (PCBTF) has a "combustible" flash point rating of 43° C./109° F., and propylene carbonate lists as "combustible" with a flash point of 107.8° C./226° F.

Organic solvents, such as acetone, xylene, ketones, esters, ethers, aliphatic hydrocarbons, and aromatic hydrocarbons such as benzene, are widely used as additives for industrial and commercial purposes. Due to the high volatility of these compounds, their uses are regulated by many countries' governmental agencies. Generally, the more flammable a solvent, the more restrictions exist on its use. Further, manufacturers that utilize solvents must handle the more flammable liquids more carefully and must address issues involving atmospheric volatility and worker health concerns due to excessive exposure to these chemicals.

"Green" solvents are regarded as such because of their sources of origin (non-petroleum based) and the fact that they biodegrade readily after use without environmental damage. Green solvents include, but are not limited to, certain alcohols such as methanol, ethanol, benzyl alcohol, certain acetates, certain esters, and turpentine. The problem with these solvents, however, is that due to their high volatility, they are considered hazardous air pollutants which violate Federal and State emissions regulations. Ethyl lactate, one example of a green solvent, has a flash point of about 115° F., which despite not being considered a Class I VOC, is still combustible, which limits its potential uses. Green esters, such as N-butyl propionate, ethyl lactate, and methyl soyate, are also considered combustible, with flash points ranging from 115° F. up to 250° F. However, they are slow to evaporate and exhibit good solvating characteristics when used in blended compositions. Nevertheless, this group of solvents is considered environmentally clean and could be utilized more extensively if their volatilities could be reduced.

Terpenes are a large and varied class of hydrocarbons with the molecular formula $(C_5H_8)_n$ and are produced naturally by a wide variety of plants and trees, such as conifers and pines. Terpenes are derived biosynthetically from units of isoprene, which has the molecular formula $C_5H_8$. The term "terpene" is sometimes used broadly to also include the terpenoids which are terpenes that have been chemically changed or modified, such as through oxidation. A terpene or terpene component, as used herein, however, may be any hydrocarbon, natural or synthetic, formed from isoprene units. Terpenes as well as terpenoids, are the primary ingredients of the essential oils of many types of trees, plants, and flowers, including citrus fruits. Terpenes are the major components of rosin (resin) as well as turpentine produced from gum rosin (resin).

The terpenes are generally classified sequentially by the number of isoprene units they contain as hemiterpenes (one isoprene unit), monoterpenes (two isoprene units), sesquiterpenes (three isoprene units), diterpenes (four isoprene units), sesterterpenes (five isoprene units), triterpenes (six isoprene units), and tetraterpenes (eight isoprene units).

As with other plant essential oils, terpenes are major constituents of the essential oils of citrus fruits. However, they are removed before the essential oil is used for flavoring beverages and foods because they tend to produce undesirable tastes when permitted to oxidize and polymerize.

Terpene hydrocarbons are liquid distillates separated from rosin pitch or sap from conifers, pine trees, citrus, and varied vegetation. The volatile terpene hydrocarbons, Chemical Abstracts Service Number (CAS#) 8006-64-2, are non-oxygenated with the molecular formula $C_{10}H_{16}$. Common names include terpenes, diterpenes, pure gum turpentine (PGT), oil of turpentine (OT), and limonene. Commercial areas of use include in paint thinners, paint strippers, cleaners, disinfectants, and pharmaceuticals.

The term "terpene" is derived from the word "turpentine". Turpentine is a volatile fluid which is distilled and refined for further commercial uses. The most common terpenes obtained from rosin (resin) distillation are the bicyclic terpenes alpha-pinene (α-pinene), beta-pinene (β-pinene), delta-3 carene (δ-3 carene), and sabinene, the monocyclic terpenes limonene and terpinolene, and smaller amounts of tricyclic sesquiterpenes longifolene, caryophyllene, and delta-cadinene. Rubber, which is a polyterpene, is one of the most widely known terpenes.

Turpentine, which is also known as spirit turpentine, oil of turpentine, and wood turpentine, is obtained by the distillation of resin from trees, usually pine trees. Turpentine prepared in this manner includes mostly alpha-pinene and beta-pinene, two terpene isomers. The exact composition of turpentine may vary from batch to batch depending on the distillation conditions and the resin source. As a solvent, turpentine has been used in varnishes and for thinning oil-based paints.

Pure gum turpentine is a complex formulation made of α-pinene (CAS#80-56-8) 40%-55% weight, β-pinene (CAS#127-91-3) 25%-35% weight, and the balance mixed trace terpenes. Pure gum turpentine is 99.5%-100% volatile, evaporating slightly less (0.9) than the reference standard (butyl acetate (1.0)), has a flash point of 35° C./95° F., a boiling point of 155-180° C., and a Kauri-butanol (Kb) value greater than 50, and is generally soluble in organic solvents.

U.S Pat. No. 8,414,797, issued Apr. 9, 2013 to Howard et al. and hereby incorporated by reference herein, discloses compositions and solvent mixtures including at least one organic solvent and at least one terpene. The solvent formulation raises the flash point of the mixture.

When a terpene is modified chemically, such as by oxidation or rearrangement of the carbon skeleton, the resulting compound is generally referred to as a terpenoid. Terpenes and terpenoids are typically derived from plants, trees, flowers, and other vegetation. They come in the form of liquids, solids, waxes, oils, and alcohols. Terpenes and terpenoids may be formed as acyclic, monocyclic, or polycyclic structures. Sometimes alternatively referred to as "isoprenoids", terpenoids are derived from five-carbon isoprene units and can be classified as "modified terpenes", where methyl groups have been moved or removed, or oxygen atoms added. Some researchers use the term terpene to include all terpenoids.

Terpenes and terpenoids in various forms have been used for centuries in fragrances due to their compatibility with other compounds and their minimal negative environmental impact. Terpineol, a terpene alcohol, has the chemical formula: $C_{10}H_{18}O$ and is found in three isomeric forms, alpha, beta, and gamma, with beta-terpineol being non-naturally occurring. Terpenes and terpenoids have been used for other purposes, such as disinfectants, cleaning compounds, soaps, cosmetics, and colognes. They are also known to add, enhance, or mask the odor of products which might be offensive to humans or animals Terpene alcohols generally have the structure of terpenes except that they include at least one hydroxyl group. A terpene alcohol or terpene alcohol component, as used herein, may be any compound, natural or synthetic, formed from isoprene units and having at least one hydroxyl group. Terpene alcohols are also derived from plants, trees, flowers, and other vegetation which allows their classification as "green compounds". Terpene alcohols are also divided into groups determined by the number of carbon atoms and repeating isoprene units. Terpene alcohols may be formed as acyclic, monocyclic, or polycyclic structures. Terpineol, a terpene alcohol, has the chemical formula: $C_{10}H_{18}O$ and is found in three isomeric forms, alpha (α), beta (β), and gamma (γ), with β-terpineol being non-naturally occurring. Terpene alcohols have been used for many purposes, including, but not limited to, disinfectants, cleaning compounds, soaps, cosmetics, and colognes. They are also known to add to, enhance, or mask the odor of products which might be otherwise offensive to humans or animals.

U.S. Pat. No. 7,273,839, issued Sep. 25, 2007 to Koetzle and hereby incorporated by reference herein, discloses the use of terpene alcohols with organic solvents and blends of solvents to increase the flash points of these solvents. Koetzle also discloses a method to decrease the flammability of normally flammable solvents using terpene alcohols, by blending the terpene alcohol into the flammable solvent. Koetzle discloses increasing the flash points of acetone, methanol, ethyl acetate, ethanol, and xylene by 50 to 60° C., by addition of 12-14% terpineol. Koetzle also discloses solvents blended with other organic solvents to produce performance solvents, such as paint strippers with flash points greater than 140° F.

Recent technological advancements in oil drilling have led to the extraction of crude oil from underground sites previously inaccessible to or unprofitably accessible by conventional oil drilling methods. Many of these new extraction sites, such as the Bakken Shale region covering parts of North Dakota, Montana, and Saskatchewan, Canada, do not have the appropriate refineries nearby to process the crude oil or pipelines to transport the crude oil to an appropriate existing refinery. This has led to an increase in the transport of crude oil by rail and on roads and highways.

It was recently reported that in 2014, more than half a million railroad tank cars of crude oil was transported, compared to just 9,500 railroad tank cars of crude oil in 2008. A number of recent railroad accidents involving tank cars transporting crude oil have led U.S. and Canadian transport officials to enact new safety rules for tank cars transporting crude oil.

Crude oil or a crude oil composition, as used herein, is an unrefined, naturally-occurring, substantially liquid mixture of hydrocarbons and other liquid organic compounds and any impurities located in and extracted from geological formations underground and formed from large quantities of dead organisms as a result of decay, heat, and pressure over millions of years. The exact composition of a crude oil varies from location to location depending on the materials from which and conditions under which it was formed. Crude oils are highly flammable with a flash point below 100° F. Although the flash point varies from one crude oil sample to another, crude oil flash points are generally in the range of 20 to 90° F.

Crude oils have been classified generally based on where they are extracted, their density, and their sulfur content. Light crude oils have a relatively low density, and heavy crude oils have a high density. Sweet crude oils have relatively little sulfur, whereas sour crude oils have a relatively high sulfur content. Light, sweet crude oils are generally the most desirable.

Petroleum or a petroleum composition, as used herein, is any form of refined or unrefined crude oil. Crude oil is conventionally refined by distillation into petroleum fuel fractions including liquefied petroleum gas, butane, gasoline, jet fuel, kerosene, fuel oil, and diesel fuel.

SUMMARY OF THE INVENTION

Transport compositions include a crude oil composition and a solvent formulation including at least one terpene component. In some embodiments, the terpene is a monoterpene. In some embodiments, the terpene is pure gum turpentine, oil of turpentine, a component of turpentine, or a combination of these. Addition of a minimal amount of solvent formulation to the crude oil composition raises the flash point of the mixture, preferably to a predetermined value, which may be in the range of 100 to 120° F., in the range of 120 to 140° F., above 140° F., or above 170° F., depending on the application. The amount of terpene is preferably in the range about 0.005 to about 5 percent by total weight of the transport composition. Methods of raising the flash point of a crude oil composition and methods of increasing the safety of handling a crude oil composition are also disclosed.

DETAILED DESCRIPTION OF THE INVENTION

In some embodiments, a transport composition includes a crude oil composition and a solvent formulation including at least one terpene component. The transport composition has a transport composition flash point higher than a crude oil composition flash point of the crude oil composition. In some embodiments, the amount of the terpene component is about 0.005 wt % to about 5 wt % of the transport composition. In some embodiments, the solvent formulation further includes acetone.

In some embodiments, the terpene component is a monoterpene. In some embodiments, the terpene component is selected from the group consisting of D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, beta-pinene, pure gum turpentine, oil of turpentine, a component of turpentine, and any combination of the above.

In some embodiments, the amount of the solvent formulation is about 0.5 wt % to about 30 wt % of the transport composition. The amount of the solvent formulation is preferably about 0.5 wt % to about 10 wt % of the transport composition. In some embodiments, the solvent formulation further comprises at least one terpenoid component. In some embodiments, the flash point of the transport composition is at least 50° F. higher than the flash point of the crude oil composition.

In some embodiments, a method of raising the flash point of a crude oil composition includes combining a solvent formulation with the crude oil composition to create a transport composition including the solvent formulation and the crude oil composition. The solvent formulation includes at least one terpene component. The transport composition has a transport composition flash point higher than a crude oil composition flash point of the crude oil composition.

In some embodiments, a method of increasing the safety of handling a crude oil composition includes combining a solvent formulation with the crude oil composition to create a transport composition including the solvent formulation and the crude oil composition. The solvent formulation includes at least one terpene component and the transport composition has a transport composition flash point above 100° F. such that the transport composition is not a flammable liquid. The method also includes transporting the transport composition in a transportation vessel to a refinery, thereby increasing the safety of handling the crude oil composition by reducing the risk of explosion of the crude oil composition during transportation to the refinery. In some embodiments, the transport vessel is a rail car, an oil tanker, or a crude oil truck.

In some embodiments, the method further includes refining the transport composition at the refinery to produce at least one fuel composition from the transport composition.

In some embodiments, the method further includes separating at least a portion of the solvent formulation from the transport composition at the refinery. In some embodiments, at least a portion of one or more of the components of the solvent formulation are separated from various fractions of petroleum compositions during the refining process of the transport composition at the refinery. In some embodiments, the separated portion of one or more of the components of the solvent formulation is recycled or reused in a solvent formulation for another crude oil composition.

In some embodiments, a transport composition includes a crude oil composition and a solvent formulation including at least one terpene. In some embodiments, the solvent formulation also includes at least one additional volatile organic compound (VOC). In some embodiments, the solvent formulation further includes at least one terpene alcohol. In some embodiments, at least one of the volatile organic compounds is a green solvent. The solvent formulation raises the flash point of the crude oil composition. A terpene or terpene component, as used herein, may be any hydrocarbon, natural or synthetic, formed from isoprene units.

The terpene is preferably a monoterpene formed from two isoprene units and having the molecular formula $C_{10}H_{16}$. Monoterpenes include, but are not limited to, D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, and beta-pinene.

More preferably, the terpene is turpentine or a component of turpentine. Turpentine, as used herein, may be any distilled resin from trees, usually pine trees. Turpentine may include at least camphene, carene, alpha-pinene, and beta-pinene in varying proportions depending on the resin source and distillation process. Gum turpentine, as used herein, is generally obtained by the distillation of sap from living pine trees, and preferably steam-distilled from *Pinus elliottii* trees. Gum turpentine preferably includes over 90% pinene, almost half of which being beta-pinene. Wood turpentine, in contrast, is generally obtained by distillation or solvent extraction from finely chopped wood chips and generally contains 75 to 85% alpha-pinene and little or no beta-pinene.

In some embodiments, the solvent formulation also includes at least one terpenoid. Terpenoids include, but are not limited to, terpene alcohols, citral, menthol, and camphor. Terpenoids generally have a vapor pressure that is less than 0.05 mm Hg, thus complying with Exempt VOC standards. Terpene alcohols include, but are not limited to, alpha terpineol, beta terpineol, gamma terpineol, geraniol, citronellol, nerol, nerolidol, and farnesol.

In some embodiments, the transport formulation consists essentially of about 0.5 to about 5 percent by total weight (wt %) of the mixture of at least one terpene and a crude oil composition. In some embodiments, the solvent formulation consists essentially of about 0.25 to 0.5 wt % of at least one terpene and about 0.25 to 0.5 wt % of a terpene alcohol and at least one volatile organic solvent. In some embodiments, the solvent formulation includes an additional volatile organic solvent. The additional volatile organic solvent is preferably an exempt VOC but may be a non-exempt VOC within the spirit of the present invention. In some embodiments, the transport formulation consists essentially of about 0.5 to 1 wt % of at least one terpene, about 5 to 10 wt % of at least one volatile organic solvent, and a crude oil composition. In some embodiments, the terpene is turpentine. In some embodiments, the terpene alcohol is alpha terpineol.

In some embodiments, a transport formulation includes about 0.5 to 1 wt % of at least one terpene, about 5 to 10 wt % of at least one volatile organic solvent, and about 89 to 95 wt % of a crude oil composition to raise the flash point of the transport formulation above 40° C. (104° F.). In some embodiments, the terpene is selected from the group consisting of gum turpentine, dipentene, terpinolene, limonene, alpha-pinene, beta-pinene, and any combination of these. In some embodiments, the volatile organic solvent is selected from the group consisting of acetone, methyl acetate, parachlorobenzotrifluoride (PCBTF), tert-butyl acetate (TBAc), dimethyl carbonate (DMC), toluene, xylene, mineral spirits, methanol, isopropanol, ethyl acetate, methyl ethyl ketone (MEK), and isobutyl isobutyrate (IBIB). The terpene may also improve the performance, economic gain, or the solvent efficiency of the solvent formulation. In some embodiments, the terpene is present in a concentration less than 0.5 wt % and may be as low as about 0.005 wt % in some embodiments.

Preferably, the solvent formulation raises the flash point of the transport formulation to above 100° F. More preferably, the solvent formulation raises the flash point of the transport formulation to above 110° F. to meet most international standards for non-flammables. More preferably, a minimum amount of terpene is used to raise the flash point to about 110 to 120° F. In other embodiments, the solvent formulation raises the flash point of the transport formulation to about 120 to 140° F., above 140° F., or above 170° F. The amount of terpene is preferably in the range of about 0.005 to about 5 wt %.

In a method of the present invention, the flash point of a sample of a crude oil formulation is optionally first determined. Flash points are then measured for transport formulations of small samples of the crude oil formulation with varying amounts of solvent formulations added, until a transport formulation having a predetermined flash point is achieved. A transport formulation with a larger amount of the crude oil formulation is then prepared based on the previously-determined level of solvent formulation that provides the predetermined flash point. Preferably, the solvent formulation produces a transport formulation with a flash point above 100° F. More preferably, the solvent formulation raises the flash point of the transport formulation to above 110° F. In some embodiments, the transport formulation has a minimal amount of at least one terpene to raise the flash point to the range of 110 to 120° F. In other embodiments, the solvent formulation raises the flash point of the transport formulation to about 120 to 140° F., above 140° F., or above 170° F.

Experiments were run to determine the flash point for solvent formulations including at least one terpene. The turpentine used to achieve the results described below was Klean-Strip® Green™ Turpentine, advertised as pure turpentine from tree resin, manufactured by W.M. Barr & Co., Inc. (Memphis, Tenn.). The material safety data sheet (MSDS) for this product lists the hazardous component as turpentine (gumspirits; supfate wood turpentine). The flash points of the pure components used in these experiments are listed in Table 1.

TABLE 1

Flash Points of Pure Solvents

| Solvent | Flash Point (° C.) | Flash Point (° F.) |
|---|---|---|
| Klean-Strip ® Green ™ Turpentine | 36 | 97 |
| D-limonene | 50 | 122 |
| acetone | −20 | −4 |
| parachlorobenzotrifluoride | 43 | 109 |
| tert-butyl acetate | 40 | 104 |
| dimethyl carbonate | 17 | 63 |
| ethyl lactate | 46 | 115 |
| xylene | 30 | 86 |
| methyl ethyl ketone | −9 | 16 |
| methanol | 12 | 54 |
| isopropanol | 12 | 53 |
| methyl acetate | −9 | 15 |

For each of the tests, the given mixtures were prepared. Each mixture was then tested in accordance with ASTM D3828, "Standard Test Methods for Flash Point by Small Scale Closed Tester", which is hereby incorporated by reference herein. Briefly, each mixture was heated to a given temperature and then exposed to a flame. The experiment was repeated multiple times for each mixture at increasing temperatures until flashing of the vapor was observed upon exposure to a flame to determine an approximate range for the flash point. The non-limiting examples below are intended only to be illustrative of the principles of the present invention.

A mixture of 0.5 wt % turpentine and 99.5 wt % acetone was measured to have a flash point in the range of 115 to 125° F.

A mixture of 1 wt % turpentine and 99 wt % acetone was measured to have a flash point in the range of 115 to 125° F.

A mixture of 3 wt % turpentine and 97 wt % acetone was measured to have a flash point in the range of 120 to 130° F.

A mixture of 0.5 wt % D-limonene and 99.5 wt % acetone was measured to have a flash point in the range of 115 to 125° F.

A mixture of 1 wt % D-limonene and 99 wt % acetone was measured to have a flash point in the range of 115 to 125° F.

A mixture of 3 wt % D-limonene and 97 wt % acetone was measured to have a flash point in the range of 115 to 125° F.

A mixture of 20 wt % acetone, 3 wt % turpentine, and 77 wt % parachlorobenzotrifluoride (PCBTF) was measured to have a flash point in the range of 175 to 185° F.

A mixture of 20 wt % acetone, 3 wt % turpentine, and 77 wt % tert-butyl acetate was measured to have a flash point in the range of 165 to 175° F.

A mixture of 20 wt % acetone, 3 wt % turpentine, and 77 wt % dimethyl carbonate was measured to have a flash point in the range of 165 to 175° F.

A mixture of 20 wt % acetone, 3 wt % turpentine, and 77 wt % ethyl lactate was measured to have a flash point above 200° F.

A mixture of 20 wt % acetone, 3 wt % turpentine, and 77 wt % xylene was measured to have a flash point in the range of 160 to 170° F.

A mixture of 20 wt % acetone, 3 wt % turpentine, and 77 wt % methyl ethyl ketone was measured to have a flash point in the range of 140 to 150° F.

A mixture of 20 wt % acetone, 3 wt % turpentine, and 77 wt % methanol was measured to have a flash point in the range of 160 to 170° F.

A mixture of 20 wt % acetone, 3 wt % turpentine, and 77 wt % isopropanol was measured to have a flash point in the range of 160 to 170° F.

A mixture of 20 wt % acetone, 1 wt % turpentine, and 79 wt % methyl acetate was measured to have a flash point in the range of 120 to 130° F.

A mixture of 20 wt % acetone, 1 wt % turpentine, and 79 wt % dimethyl carbonate was measured to have a flash point in the range of 160 to 170° F.

In some embodiments, methods of raising the flash point of a crude oil formulation use pure gum turpentine and to a lesser extent other terpenes, as defined herein and represented by varied tests involving substitution in selected procedures to confirm their individual capabilities or efficiencies. Of the terpenes tested, pure gum turpentine was previously determined to offer the best and broadest measure of performance using the least weight addition in a solvent formulation or blend.

In some embodiments, a solvent formulation includes pure gum turpentine (PGT) in the range of 0.005 to 1 percent by total weight of the mixture (wt %) added to acetone. The solvent formulation is complete, clear and stable, and benefits from a slight pine scent. Pure acetone has a distinct odor, with a flash point of about −20° C./−4° F., and pure gum turpentine has a flash point of about 35° C./95° F. The solvent formulation had a flash point of greater than 47° C./118° F. when tested in accordance with ASTM D-3828 as confirmed by a three-test average. The use of 0.5 to 1 wt % pure gum turpentine in acetone is significant because the VOC weighting (contribution) is less than 4 g/L, making the mixture quite useable to reduce emissions and comply with current environmental regulations for total weight discharged. The evaporation rate for acetone and the weight residual based upon an evaporation test was below the measurement capability and significantly lower than the evaporation rate of pure acetone. A color or stain residual on a clean white panel after evaporation was not perceptible, thus confirming complete evaporation.

A test objective was to determine the effectiveness and efficiency of a mixture of a VOC and pure gum turpentine. VOCs were selected from the Federal Register 40 CFR 51.100(s) list of Exempt VOCs, applicable to the Federal EPA Emissions Regulations for Industrial Atmospheric Discharge, which includes acetone, methyl acetate, tertiary butyl acetate, p-chlorobenzotrifluoride, and dimethyl carbonate.

PGT Test #1: Laboratory solutions were prepared for PGT in acetone at 0.25 wt %, 0.5 wt %, 1 wt %, 2 wt %, 3 wt %, 5 wt %, and 10 wt % in acetone. The subsequently-measured flash points showed a steady increase from about 47° C./118° F. for 0.25 wt % up to a peak reading of about 52° C./125° F. for the 3 wt % loading of PGT. All flash points were conducted in accordance with ASTM D-3828 standard test methods for flash point by small scale closed tester. All test results were the average of three tests.

PGT Test #2: Methyl acetate, with a low flash point of about −10.5° C./15° F., was selected from the list of exempt VOCs. PGT was thoroughly mixed at 2 wt % with methyl acetate, forming a clear solution. The mixture was permitted to stabilize for 12 hours and was tested in accordance with ASTM D-3828. The flash point of the mixture was determined to be about 55.6° C./132° F. (the average of three tests). The VOC contribution of the PGT was 2 wt % or about 18.4 g/L.

PGT Test #3: Methyl acetate was evaluated by treatment with a blend of PGT and acetone. PGT was mixed well with acetone at a weight ratio of 3:20 to form the blend. The blend was then added to methyl acetate at a weight ratio of 23:77, and the resulting solvent mixture was mixed well. The mixture was permitted to stabilize for 12 hours and was tested in accordance with ASTM D-3828. The flash point of the mixture was determined to be about 76.7° C./170° F. (the average of three tests). The VOC contribution of the PGT was 3 wt % or about 27.6 g/L.

PGT Test #4: Tertiary butyl acetate was evaluated by treatment with a blend of PGT and acetone. PGT was mixed well with acetone at a weight ratio of 3:20 to form the blend. The blend was then added to tertiary butyl acetate at a weight ratio of 23:77, and the resulting solvent mixture was mixed well. The mixture was permitted to stabilize for 12 hours and was tested in accordance with ASTM D-3828. The flash point of the mixture was determined to be about 76.7° C./170° F. (the average of three tests). The VOC contribution of the PGT was 3 wt % or about 26.5 g/L.

PGT Test #5: P-Chlorobenzotrifluoride was evaluated by treatment with a blend of PGT and acetone. PGT was mixed well with acetone at a weight ratio of 3:20 to form the blend. The blend was then added to p-chlorobenzotrifluoride at a weight ratio of 23:77, and the resulting solvent mixture was mixed well. The mixture was permitted to stabilize for 12 hours and was tested in accordance with ASTM D-3828. The flash point of the mixture was determined to be about 74.4° C./166° F. (the average of three tests). The VOC contribution of the PGT was 3 wt % or about 40.7 g/L.

PGT Test #6: Dimethyl carbonate was evaluated by treatment with a blend of PGT and acetone. PGT was mixed well with acetone at a weight ratio of 3:20 to form the blend. The blend was then added to dimethyl carbonate at a weight ratio of 23:77, and the resulting solvent mixture was mixed well. The mixture was permitted to stabilize for 12 hours and was tested in accordance with ASTM D-3828. The flash point of the mixture was determined to be about 76.7° C./170° F. (the average of three tests). The VOC contribution of the PGT was 3 wt % or about 27.9 g/L.

Terpineols, which are a type of terpene alcohol, have been previously mixed and tested with various VOCs and exempt VOCs in order to raise the respective flash points to a more safe level for use. Solvent mixtures with terpenes or terpenes mixed with terpineols were tested for the ability to speed the evaporation rate of mixed terpene alcohols.

Additionally, a series of tests were conducted blending terpineols with terpenes at low weight concentrations to determine effectiveness for raising the flash point of a volatile organic solvent. Initial weight loadings were restricted to 5 wt % or less of the terpene/terpineol mixture with at least 95 wt % of acetone. The terpene used was IFF-5100 (International Flavors & Fragrances, Inc., New York, N.Y.), a commercial dipentene and the evaporation rate of the mixture was reduced by 50% compared to a blend of 5% α-terpineol and acetone. A range of ratios were prepared to determine the optimum ratios for evaporation improvement; however, a 50-50 mixture of terpene and terpene alcohol was determined to be the best overall at raising the flash point.

Based upon the success of mixed α-terpineol and terpene to raise the flash point, a variety of commercial terpenes were tested to determine their respective influence on the flash point of acetone. Commercially available terpenes, more specifically pure gum turpentine (PGT), terpene, dipentene, and limonene were selected and acquired for testing. Each terpene was tested separately and blended with acetone at 5 wt %. Acetone was chosen as the most effective medium for testing, as it is an exempt VOC, has a low flash point of −20° C./−4° F., and is classified as "hazardous and flammable". When tested in accordance with ASTM D-3828 the mixture of 95 wt % acetone and 5 wt % terpene was measured to have a flash point reading of 49° C./120° F. Based upon the success of preliminary testing, a test procedure was established for increasing weight loadings to determine an optimum efficiency. A maximum flash point of 52° C./125° F., as an average of three tests, was achieved for a solvent mixture of 3 wt % of PGT mixed with 97 wt % acetone.

The five major exempt VOCs, acetone, methyl acetate, tertiary butyl acetate, dimethyl carbonate, and p-chlorobenzotrifluoride, were selected for the purpose of testing in solvent mixtures with PGT to determine the effect of PGT on the flash point of each respective VOC. Of major concern was the amount of PGT used in the test mixtures because PGT is itself classified as a VOC and regulated for environmental emissions. When PGT was mixed at 0.5 wt % with acetone, the mixture achieved a flash point reading of 47° C./118° F., a substantial increase in the flash point relative to pure acetone. Testing was continued maintaining the PGT loading at 3 wt % for the selected Exempt VOCs. Calculating the acetone blend at 3 wt % of pure gum turpentine, the respective VOC loading for reporting purposes would be 23.97 g/L. A minor benefit in lieu of the safety gain is the fact that PGT is a renewable compound and classified as a "green" substance.

The resulting trials and following test data provide evidence for the ability of "raising the flash points" of Exempt VOCs and making them safer, less hazardous, and therefore more useable for the purposes for which they were intended by the mixing with one or more terpenes. The elevated flash points affect manufacturing costs, insurance, storage, containerization, packaging, and shipping of products.

Terpene Test #1: Dipentene 5100 was mixed at 0.5 wt % with acetone, making a clear stable solution. Dipentene 5100 has a slight pine odor and a flash point of about 46° C./115° F., and pure acetone has a flash point of about −20° C./−4° F. The mixture was mixed well, was permitted to stabilize for 12 hours, and was tested in accordance with ASTM D-3828. The flash point was determined to be about 49° C./120° F. (the average of three tests).

Terpene Test #2: Dipentene 5100 was mixed at 3 wt % with acetone, making a clear stable solution. The mixture was permitted to stabilize for 12 hours and was tested in accordance with ASTM D-3828. The flash point was determined to be about 52° C./125° F. (the average of three tests).

Terpene Test #3: Unitene-D (International Flavors & Fragrances, Inc., New York, N.Y.), a dipentene (CAS#68956-56-9), was mixed at 3 wt % with acetone, making a clear stable solution. The mixture was permitted to stabilize for 12 hours and was tested in accordance with ASTM D-3828. The flash point was determined to be about 52° C./126° F. (the average of three tests).

Terpene Test #4: Pure gum turpentine (W.M. Barr & Co., Inc., Memphis, Tenn.) was thoroughly mixed at 0.5 wt % with acetone. PGT has a flash point of about 32° C./95° F. The mixture was permitted to stabilize for 12 hours and was tested in accordance with ASTM D-3828. The flash point was determined to be about 49° C./120° F. (the average of three tests).

Terpene Test #5: Pure gum turpentine was thoroughly mixed at 1 wt % with acetone. The mixture was permitted to stabilize for 12 hours and was tested in accordance with ASTM D-3828. The flash point was determined to be about 50° C./122° F. (the average of three tests).

Terpene Test #6: Limonene (Florida Chemical Co., Inc., Winter Haven, Fla.) was thoroughly mixed at 0.5 wt % with acetone. Limonene has a flash point of about 48° C./119° F. The mixture was permitted to stabilize for 12 hours and was tested in accordance with ASTM D-3828. The flash point was determined to be about 46.7° C./116° F. (the average of three tests).

Terpene Test #7: Limonene was thoroughly mixed at 1 wt % with acetone. The mixture was permitted to stabilize for 12 hours and was tested in accordance with ASTM D-3828. The flash point was determined to be about 51° C./124° F. (the average of three tests).

Terpene Test #8: Pure gum turpentine was thoroughly mixed at 3 wt % with acetone. The mixture was permitted to stabilize for 12 hours and was tested in accordance with ASTM D-3828. The flash point was determined to be about 53.3° C./128° F. (the average of three tests). This mixture had the highest flash point of those tested in this series.

Terpene Test #9: Limonene was thoroughly mixed at 3 wt % with acetone. The mixture was permitted to stabilize for 12 hours and was tested in accordance with ASTM D-3828. The flash point was determined to be about 48° C./118° F. (the average of three tests).

The terpene test results using acetone confirm that terpenes in general, when mixed with acetone at less than 5 wt %, raise the flash point of the solvent mixture to at least about 46.7° C./116° F., and become optimum at about a 3 wt % loading. Of the terpenes tested, pure gum turpentine had the greatest effect and best efficiency performance based upon these tests, raising the flash point of acetone by addition of just 0.5 wt % to about 49° C./120° F.

The above-discussed testing centered on solvent mixtures of terpenes and acetone. The efficiency of PGT permits the use of a "blend", where a fixed amount of PGT is mixed with acetone to make a premix blend. The premix blend is then added to a specific crude oil composition, thus completing the transport composition. Alternatively, the premix blend may be combined with another volatile organic solvent to make a solvent formulation that is then added to a specific crude oil composition, thus completing the transport composition. In some embodiments, a standard premix blend is added to a volatile organic solvent or to a crude oil composition or blend of crude oil compositions. In some embodiments, the premix blend is PGT and acetone in a weight ratio in the range of 3:74 to 3:20. In some embodiments, this pre-mix blend is then mixed with the crude oil composition in a weight ratio in the range of 1:15 to 23:77 or with another volatile organic solvent in a weight ratio in the range of 7:3 to 4:1.

In some embodiments, the total amount of terpenes added to the solvent formulation is selected to raise the flash point of the solvent formulation to a predetermined value. In some embodiments, the predetermined value is in the range of about 110 to about 120° F. In some embodiments, the total amount of terpenes added to the solvent formulation is selected to raise the flash point of the solvent formulation above a predetermined value. In some embodiments, the predetermined value is about 110° F.

In some embodiments, the amount of acetone and the total amount of terpenes added to the solvent formulation are selected to raise the flash point of the solvent formulation to a predetermined value. In some embodiments, the predetermined value is in the range of about 110 to about 120° F. In some embodiments, the amount of acetone and the total amount of terpenes added to the solvent formulation are selected to raise the flash point of the solvent formulation above a predetermined value. In some embodiments, the predetermined value is about 110° F.

In some embodiments, pure gum turpentine is blended with acetone in an amount in the range of about 0.005 wt % to about 10 wt % to form a stable solvent mixture while raising the flash point of the acetone from about −20° C./−4° F. to at least about 43.3° C./110° F., as measured in accordance with ASTM D-3828 test procedure. In some embodiments, the pure gum turpentine is identified by CAS#9005-90-7.

In some embodiments, pure gum turpentine is blended with acetone in an amount of about 3 wt % to form a stable solvent mixture improved by the addition of a pine odor and a flash point raised from about −20° C./−4° F. up to about 52° C./125° F., as measured in accordance with ASTM D-3828.

In some embodiments, the pure gum turpentine is partially or fully replaced by weight by oil of turpentine (OT) in solvent mixtures to perform identically or similarly to the pure gum turpentine alone. In some embodiments, the oil of turpentine is identified by CAS#8006-64-2.

In some embodiments, the pure gum turpentine and/or oil of turpentine is mixed in approximately equal weight portions with one or more terpene alcohols to form a stable compound exhibiting a reduction in the evaporation rate of mixture in comparison to the evaporation rate of the unmixed terpene alcohols. In some embodiments, the reduction in the evaporation rate is 50%.

In some embodiments, the pure gum turpentine and oil of turpentine are mixed in approximately equal weight portions to form a stable mixture and added at about 3 wt % to acetone to raise the flash point of the acetone from about −20° C./−4° F. to about 48.9° C./120° F., as measured in accordance with ASTM D-3828 test procedure.

In some embodiments, the pure gum turpentine and/or oil of turpentine, when added to a crude oil composition in an amount of about 5 wt % or less, raises the flash point of the crude oil composition mixture from below about 37.8° C./100° F., to greater than about 43.3° C./110° F.

In some embodiments, the pure gum turpentine and/or oil of turpentine, being "green" compounds obtained from vegetation, preferably mainly pine trees or conifers, may be classified as such and may be blended with other "green" VOCs, oils, and esters to maintain a "green" classification for marketing purposes.

In some embodiments, the premix blend is based upon a mixture of about 0.05 wt % to about 2 wt % of pure gum turpentine and/or oil of turpentine and about 7 wt % to about 10 wt % acetone, based on the weight of the transport composition, to be mixed with a crude oil composition, the crude oil composition forming at least 88 wt % of the transport composition, to raise the flash point of the crude oil composition from below about 35° C./95° F. to above about 37.8° C./100° F., thereby converting the "hazardous, flammable" classification to "combustible" and affording a wider range of safety.

In some embodiments, the premix blend is based upon a mixture of pure gum turpentine, oil of turpentine, and a terpene alcohol in any proportions, the mixture not to exceed about 6 wt % and added to acetone, thus forming the premix blend, which may be then added to another volatile organic solvent to form a solvent formulation to add to a crude oil composition or blend of crude oil compositions or added directly to a crude oil composition or blend of crude oil compositions to raise the flash point of the mixture from below about 35° C./95° F., to above about 37.8° C./100° F., thereby converting the "hazardous, flammable" classification to "combustible" and affording a wider range of safety in transportation. In some embodiments, the crude oil composition forms at least 90 wt % of the final transport composition.

In some embodiments, the premix blend is based upon pure gum turpentine at 5 wt % to 9 wt % mixed with acetone at 91 wt % to 95 wt %. In some embodiments, the premix blend is stored, containerized, sealed, and used at a later date to blend or mix with another volatile organic solvent to form a solvent formulation to add to a crude oil composition or blend of crude oil compositions or added directly to a crude oil composition, for the purpose of raising the flash point of the crude oil composition.

In some embodiments, the premix blend is based upon pure gum turpentine and/or oil of turpentine and is classified as a 90% Exempt VOC by the blend including acetone at about 90 wt %.

Several solvent formulations were combined with several different crude oil compositions to form transport compositions, and the flash points of the transport compositions were determined. A solvent formulation of 94 wt % acetone and 6 wt % turpentine was first tested at 10 wt % and 15 wt % with a crude oil composition at 90 wt % and 85 wt % and achieved an acceptable flash point but did not mix completely with the crude oil composition. Addition of xylene at 20 wt % to 30 wt % in place of part of the acetone produced a solvent formulation that mixed well with crude oil samples. Xylene was selected, in part, as it is readily recoverable at the end of the crude oil refining process, but other solvents may be used in place of xylene, including, but not limited to, toluene. A preferred solvent formulation for certain crude oil compositions is 74 wt % acetone, 20 wt % xylene, and 6 wt % turpentine. Another preferred solvent formulation for certain crude oil compositions is 64 wt % acetone, 30 wt % xylene, and 6 wt % turpentine.

In some embodiments, the solvent formulation includes 6 wt % turpentine, with the balance of the composition being acetone and xylene. The turpentine preferably stays the same at 6%. In other embodiments, the amount of turpentine is in the range of 5 to 7 wt %. The ratio of acetone to xylene in the solvent formulation may be adjusted for different crude oil samples to minimize the amount of solvent formulation sufficient to achieve a transport composition having a predetermined flash point.

A crude oil sample from American Refining Group Inc. (Bradford, Pa.) having a flash point in the range of 70 to 90° F. was mixed at 90 wt % with 10 wt % of a solvent formulation of 74% acetone, 20% xylene, and 6% turpentine to form a transport composition having a flash point measured to be in the range of 200 to 210° F.

A crude oil sample of Pennsylvania Grade Crude Oil from Ergon, Inc. (Newell, W. Va.) having a flash point in the range of 70 to 90° F. was mixed at 90 wt % with 10 wt % of a solvent formulation of 74% acetone, 20% xylene, and 6% turpentine to form a transport composition having a flash point measured to be in the range of 145 to 150° F. The effect of the amount of xylene in the solvent formulation was tested by varying the amount of xylene in the range of 10 wt % to 80 wt %, with the highest flash point for a transport composition being measured with 30 wt % xylene. The crude oil sample from Ergon, Inc. at 90 wt % mixed with 10 wt % of a solvent formulation of 64% acetone, 30% xylene, and 6% turpentine formed a transport composition having a flash point measured to be in the range of 170 to 175° F.

A crude oil fraction from Noble Oil Services Inc. (Sanford, N.C.) was a clear yellow liquid labeled "lite ends" with an analysis sheet reporting a flash point of −10° F. The crude oil fraction was mixed at 90 wt % with 10 wt % of a solvent formulation of 74% acetone, 20% xylene, and 6% turpentine to form a transport composition having a flash point measured to be in the range of 170 to 175° F.

In some embodiments, the solvent formulation is selected to combine with a crude oil composition having a flash point below 140° F. to form a transport composition having a flash point of at least 140° F. Such a transport composition may be classified as a Class III liquid. Crude oil compositions may differ in their chemical compositions and physical properties, however, depending on the source of the crude oil composition, and different solvent formulations may work better on different crude oil compositions to achieve a flash point of at least 140° F. Although a 10 wt % solvent formulation has been shown to achieve this result, 11 wt % or 12 wt % of a solvent formulation may be required for some crude oil compositions. In some embodiments, the crude oil composition forms at least 88 wt % of the final transport composition.

In some embodiments it may be economically desirable to use a minimum amount of solvent formulation that achieves this result. In some such embodiments, the result of a flash point of at least 140° F. is achieved with a solvent formulation in a range as low as 7 wt % to 8 wt % of the transport composition. In some embodiments, the crude oil composition forms at least 92 wt % of the final transport composition.

In some embodiments, the transport composition is transported from the extraction site to a refinery by one or more transport vehicles. The refinery may be more than 500 miles or more than 1000 miles away from the extraction site. In some embodiments, the transport vehicle is a rail car. In other embodiments, the transport vehicle is an oil tanker. In yet other embodiments, the transport vehicle is a crude oil truck. When the transport composition reaches the refinery, the transport composition may be refined to obtain any products normally obtained from crude oil.

In some embodiments, one or more components of the solvent formulation are recovered in whole or in part either during the refining process or as a preliminary step prior to the refining process for reuse in a solvent formulation to be combined with another crude oil composition to form another transport composition. Since the recovered solvent formulation components may be recovered for the intended use of combining with another crude oil composition, the recovered solvent formulation components need not be pure and may include small amounts of one or more components from the crude oil composition as impurities.

Although the invention has been described primarily with pure gum turpentine being the terpene component included in a solvent formulation, any terpene or mixture of terpenes may be used in combination with or in place of the particular terpene component or components described in any of the solvent mixtures described herein within the spirit of the present invention. Terpenes for use in solvent formulations include, but are not limited to, D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, and beta-pinene.

In other embodiments, the solvent formulation includes no terpene but at least one terpene alcohol component in place of the terpene. In some embodiments, the terpene alcohol is terpineol.

In some embodiments, the optimum solvent formulation for a specific crude oil composition depends on the specific characteristics of the crude oil composition, including its native flash point and its native density, which are largely a function of where it was extracted from the ground.

In some embodiments, a method of raising the flash point of a crude oil composition includes testing the crude oil composition to determine one or more physical or chemical characteristics of the crude oil composition, which may include, but is not limited to, the flash point of the crude oil composition, the density of the crude oil composition, or the chemical composition of the crude oil composition. In some embodiments, a method of raising the flash point of a crude oil composition includes selecting a solvent formulation based on one or more physical or chemical characteristics of the crude oil composition or based on a target minimum flash point for the transport composition. In some embodiments, the solvent formulation and the crude oil composition, when combined, form a transport composition with a flash point equal to the target minimum flash point. In some embodiments, the solvent formulation and the crude oil composition, when combined, form a transport composition with a flash point greater than or equal to the target minimum flash point. In some embodiments, the solvent formulation and the crude oil composition, when combined, form a transport composition with a flash point greater than the target minimum flash point.

In some embodiments, the target minimum flash point for the transport composition depends on the mode of transport for transporting the transport composition. In some embodiments, the target minimum flash point is selected based on government regulations for the mode of transport, which may vary, depending on the mode of transport. In some embodiments, the target minimum flash point for the transport composition is 100° F. In some embodiments, the target minimum flash point for the transport composition is 110° F. In some embodiments, the target minimum flash point for the transport composition is 140° F. In some embodiments, the target minimum flash point for the transport composition is 170° F. In some embodiments, the target minimum flash point for the transport composition is 200° F.

The amount and composition of the solvent formulation depends not only on the crude oil composition but also the target minimum flash point for the transport composition. In some embodiments, the terpene content in the solvent formulation is optimized to minimize the amount of solvent formulation needed to raise the flash point of the transport composition to at least the target minimum flash point. In some embodiments, the transport composition includes about 0.005 wt % to about 2 wt % of at least one terpene component, about 5 wt % to about 10 wt % acetone, about 1 wt % to about 4 wt % of at least one additional volatile organic solvent, and about 86 wt % to about 96 wt % of crude oil. In some embodiments, the transport composition includes about 0.5 wt % to about 0.7 wt % of at least one terpene component, about 6 wt % to about 8 wt % acetone, about 2 wt % to about 3 wt % of at least one additional volatile organic solvent, and about 88.3 wt % to about 91.5 wt % of crude oil.

In some embodiments, the solvent formulation is mixed with a refined crude oil composition, i.e. a petroleum composition. In some embodiments, the petroleum composition is liquefied petroleum gas. In some embodiments, the petroleum composition is butane. In some embodiments, the petroleum composition is gasoline. In some embodiments, the petroleum composition is jet fuel. In some embodiments, the petroleum composition is kerosene. In some embodiments, the petroleum composition is fuel oil. In some embodiments, the petroleum composition is diesel fuel. In some embodiments, the solvent formulation raises the flash point of the petroleum composition to improve the safety of transporting or storing the petroleum composition. In some embodiments, at least a portion of one or more of the components of the solvent formulation is separated from the petroleum composition before the petroleum composition is used as a fuel source. In some embodiments, the separated portion of one or more of the components of the solvent formulation is recycled or reused in a solvent formulation for another petroleum composition.

All above-mentioned references are hereby incorporated by reference herein.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A transport composition comprising:

a crude oil composition having a crude oil composition flash point, wherein the crude oil composition is an unrefined, naturally-occurring, substantially liquid mixture of hydrocarbons and other liquid organic compounds and any impurities extracted from geological formations underground; and a solvent formulation mixed with the crude oil composition, the solvent formulation comprising at least 60 wt % acetone, 0.25 wt % to 10 wt % of at least one terpene, and an additional volatile organic solvent selected from the group consisting of xylene, toluene, and p-chlorobenzotrifluoride;

wherein an amount and a composition of the solvent formulation are selected such that the transport composition has a transport composition flash point at least 10° F. higher than the crude oil composition flash point.

2. The transport composition of claim 1, wherein the terpene is selected from the group consisting of D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, beta-pinene, pure gum turpentine, oil of turpentine, a component of turpentine, and any combination of the above.

3. The transport composition of claim 1, wherein the amount of the terpene is about 0.05 wt % to about 5 wt % of the transport composition.

4. The transport composition of claim 1, wherein the amount of the solvent formulation is about 0.5 wt % to about 15 wt % of the transport composition.

5. The transport composition of claim 1, wherein the transport composition flash point is at least 50° F. higher than the crude oil composition flash point.

6. The transport composition of claim 1, wherein the crude oil composition is at least 88 wt % of the transport composition, the at least one terpene is less than or equal to 1 wt % of the transport composition, and the transport composition flash point is at least 140° F.

7. The transport composition of claim 1, wherein the transport composition consists of the crude oil composition and the solvent formulation and wherein the solvent formulation consists of the at least one terpene, the acetone, and up to 30 wt % of the additional volatile organic solvent.

8. A method comprising the steps of:

selecting an amount and a composition of a solvent formulation comprising 60 wt % to 99.75 wt % acetone, 0.25 wt % to 10 wt % of at least one terpene, and up to 30 wt % of an additional volatile organic solvent, selected from the group consisting of xylene, toluene, and p-chlorobenzotrifluoride, such that mixing the solvent formulation with a crude oil composition having a crude oil composition flash point produces a transport composition having a transport composition flash point at least 10° F. higher than the crude oil composition flash point; and mixing the solvent formulation with the crude oil composition to create the transport composition having the transport composition flash point, the transport composition comprising the solvent formulation mixed with the crude oil composition;

wherein the crude oil composition is an unrefined, naturally-occurring, substantially liquid mixture of hydrocarbons and other liquid organic compounds and any impurities extracted from geological formations underground.

9. The method of claim 8, wherein the amount of the crude oil composition is at least 88 wt % of the transport composition.

10. The method of claim 8, wherein the terpene is selected from the group consisting of D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, beta-pinene, pure gum turpentine, oil of turpentine, any component of turpentine, and any combination of the above.

11. The method of claim 8, wherein the transport composition flash point is at least 50° F. higher than the crude oil composition flash point.

12. The method of claim 8, wherein the crude oil composition is at least 90 wt % of the transport composition, the at least one terpene is less than or equal to 1 wt % of the transport composition, and the transport composition flash point is at least 140° F.

13. The method of claim 8, wherein the transport composition consists of the solvent formulation and the crude oil composition and wherein the solvent formulation consists of 0.25 wt % to 10 wt % of the at least one terpene and 90 wt % to 99.75 wt % of the acetone.

14. A method of increasing the safety of handling a crude oil composition having a crude oil composition flash point below 100° F., the method comprising the steps of:

a) selecting an amount and a composition of a solvent formulation comprising 60 wt % to 99.75 wt % acetone, 0.25 wt % to 10 wt % of at least one terpene, and up to 30 wt % of an additional volatile organic solvent, selected from the group consisting of xylene, toluene, and p-chlorobenzotrifluoride, such that mixing the solvent formulation with the crude oil composition produces a transport composition having a transport composition flash point above 110° F.;

b) mixing the solvent formulation with the crude oil composition to create the transport composition having the transport composition flash point and comprising the solvent formulation mixed with the crude oil composition such that the transport composition is not a flammable liquid; and c) transporting the transport composition in a transportation vessel, selected from the group consisting of a rail car, an oil tanker, and a crude oil truck, to a refinery, thereby increasing the safety of handling the crude oil composition by reducing the risk of explosion of the crude oil composition during transportation to the refinery;

wherein the crude oil composition is an unrefined, naturally-occurring, substantially liquid mixture of hydrocarbons and other liquid organic compounds and any impurities extracted from geological formations underground.

15. The method of claim 14, wherein the amount of the crude oil composition is at least 88 wt % of the transport composition.

16. The method of claim 14, wherein the terpene is selected from the group consisting of D-limonene, L-limonene, dipentene, terpinolene, alpha-ocimene, beta-ocimene, myrcene, alpha-terpinene, beta-terpinene, gamma-terpinene, sabinene, alpha-thujene, beta-thujene, camphene, carene, alpha-pinene, beta-pinene, pure gum turpentine, oil of turpentine, any component of turpentine, and any combination of the above.

17. The method of claim 14, wherein the transport composition flash point is at least 50° F. higher than the crude oil composition flash point.

18. The method of claim 14, wherein the crude oil composition is at least 90 wt % of the transport composition, the at least one terpene is less than or equal to 1 wt % of the transport composition, and the transport composition flash point is at least 140° F.

19. The method of claim 14, wherein the transport composition consists of the solvent formulation and the crude oil composition and wherein the solvent formulation consists of 0.25 wt % to 10 wt % of the at least one terpene, 60 wt % to 89.75 wt % acetone, and 10 wt % to 30 wt % of the additional volatile organic solvent.

20. The method of claim 14, further comprising separating at least a portion of the solvent formulation from the transport composition at the refinery.

21. The transport composition of claim 1, wherein the solvent formulation comprises 10 wt % to 30 wt % of the additional volatile organic solvent.

22. The method of claim 8, wherein the solvent formulation comprises 60 wt % to 89.75 wt % of the acetone, 0.25 wt % to 10 wt % of the at least one terpene, and 10 wt % to 30 wt % of the additional volatile organic solvent.

* * * * *